US009944361B2

(12) United States Patent
Cho

(10) Patent No.: US 9,944,361 B2
(45) Date of Patent: Apr. 17, 2018

(54) MOTORIZED BOARD FOR USE ON WATER

(71) Applicant: David Hyun Jong Cho, Citrus Heights, CA (US)

(72) Inventor: David Hyun Jong Cho, Citrus Heights, CA (US)

( * ) Notice: Subject to any disclaimer, the term of this patent is extended or adjusted under 35 U.S.C. 154(b) by 0 days.

(21) Appl. No.: 15/052,723

(22) Filed: Feb. 24, 2016

(65) Prior Publication Data

US 2017/0240254 A1 Aug. 24, 2017

(51) Int. Cl.

| | |
|---|---|
| ***B63B 1/24*** | (2006.01) |
| ***B63B 35/79*** | (2006.01) |
| ***B63H 21/21*** | (2006.01) |
| *B63B 35/81* | (2006.01) |

(52) U.S. Cl.

CPC ..... *B63B 35/7943* (2013.01); *B63H 21/21* (2013.01); *B63B 1/24* (2013.01); *B63B 2035/813* (2013.01); *B63H 2021/216* (2013.01)

(58) Field of Classification Search

CPC ..... B63B 35/7926; B63B 35/793; B63B 35/7943; B63B 1/24

See application file for complete search history.

(56) References Cited

U.S. PATENT DOCUMENTS

| | | | | |
|---|---|---|---|---|
| 1,814,772 A * | 7/1931 | Sterling | B63B 35/7943 | 440/1 |
| 2,744,267 A * | 5/1956 | Roby | B63B 35/731 | 114/271 |
| 3,394,673 A * | 7/1968 | Hamori | B63B 1/22 | 114/55.55 |
| 3,948,206 A * | 4/1976 | Tyler | B63B 1/18 | 114/55.51 |
| 5,809,926 A * | 9/1998 | Kelsey | B63B 1/286 | 114/274 |
| 2015/0336649 A1* | 11/2015 | Radenbaugh | B63H 25/42 | 440/79 |

FOREIGN PATENT DOCUMENTS

| | | | | |
|---|---|---|---|---|
| DE | 2533234 A1 * | 2/1977 | B63B 35/7943 | |

* cited by examiner

*Primary Examiner* — Andrew Polay
(74) *Attorney, Agent, or Firm* — Innovation Counsel LLP

(57) ABSTRACT

A motorized board similar to a surf board is presented for use on a water surface. The motorized board includes a base board having a front end and a back end, a foot pedal on the base board, wherein the foot pedal is rotatable on the base board, and a motor coupled to the base board and connected to a propeller at the back end, the motor being controlled by the foot pedal. A user can stand on the board and turn the motor on with his foot, as well as control the speed with his foot to ride on a water surface with or without waves.

10 Claims, 8 Drawing Sheets

MOTORIZED BOARD FOR USE ON WATER

TECHNICAL FIELD

The disclosure relates to a board, and in particular, to a motorized board with controls that can be used on water.

BACKGROUND

There are many different kinds of water sports that can be casually enjoyed by people visiting beaches and lakes, such as motor-boating, surfing, sailing, diving, canoeing, and water-skiing, among others. While each of these activities is fun for its own reasons, none of them is without a shortcoming. For example, for surfers, the need for the right wave conditions may be a source of frustration. For the water-skiers, the activity's dependence on a boat may be a limitation that they could do without. Hence, there is room for yet another type of water sport.

SUMMARY OF THE DISCLOSURE

According to one aspect of the inventive concept, a motorized board for use on a water surface is presented. The motorized board includes a base board having a front end and a back end, a foot pedal on the base board, wherein the foot pedal is rotatable on the base board, and a motor coupled to the base board. The motor is connected to a propeller at the back end and is controlled by the foot pedal. A user may stand on the board and control the speed of the board with his foot to go for a ride on a water surface.

DETAILED DESCRIPTION

The motorized board described herein is similar to a surf board in the sense that it allows a user to stand on the board and float on a water surface. However, unlike a surf board, it has a motor near the back end that can be controlled by the foot/feet of the user. By pushing down on the front part of his foot, for example, the user may turn the engine on. He can control the speed by pushing the front part of his foot to accelerate, or decelerate and eventually idle by pushing the heel down. The user can control the direction of the board by leaning, the same way he would on a surf board. The motorized board of the inventive concept may be used with or without waves.

Figure 1:
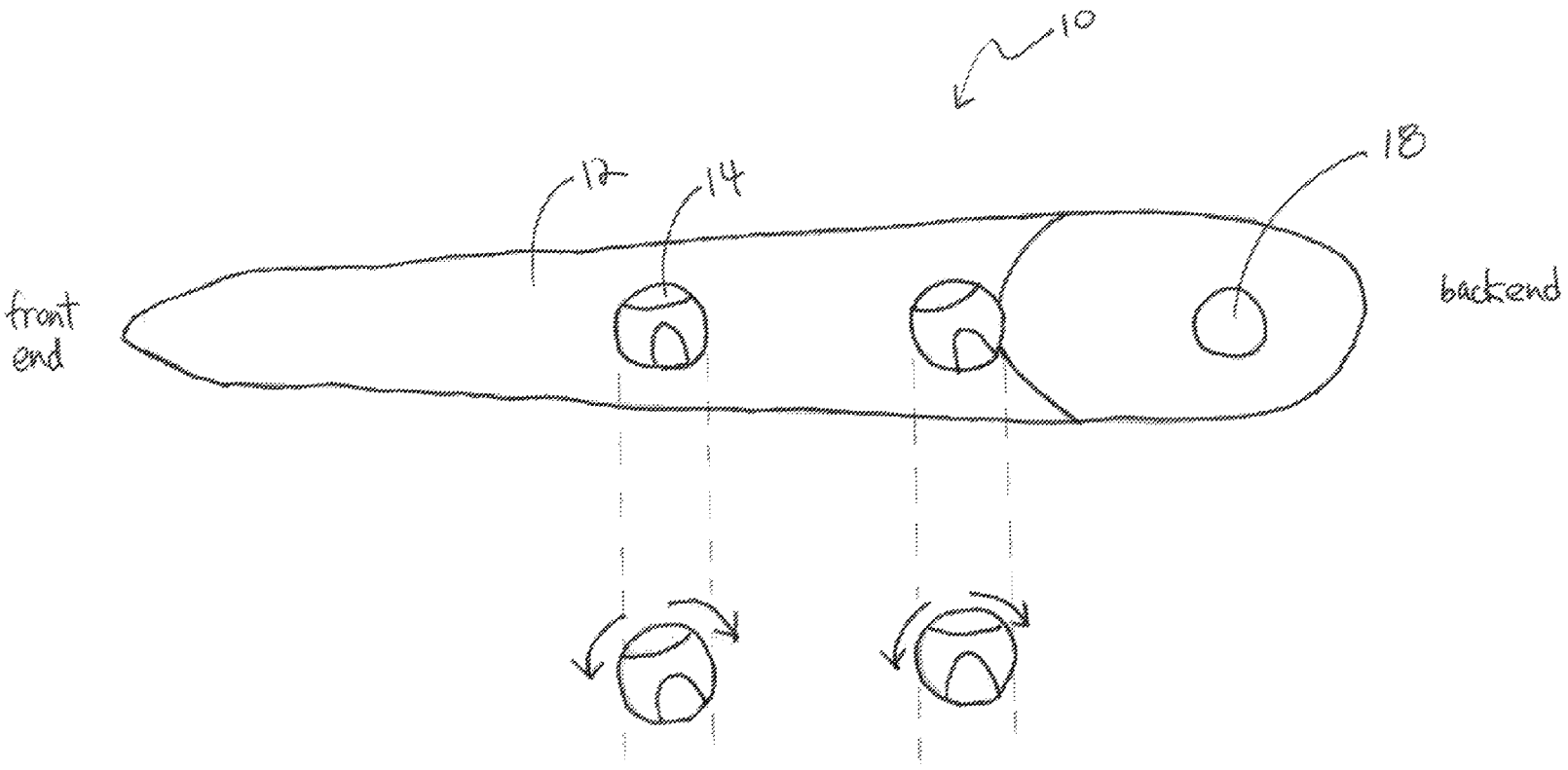
FIG. 1 depicts a top plan view of a motorized board in accordance with the inventive concept.

FIG. 1 depicts a top plan view of a motorized board 10 in accordance with the inventive concept. As shown, the motorized board 10 includes a base board 12, a foot pedal 14, an air bladder 16, and a motor 18. The base board 12 may be a board similar to a surf board, having an elongated tapered oval shape with a substantially flat top surface. The base board may be made of plastic material that is reinforced with fiberglass. Alternatively, the base board 12 may be an inflatable (e.g., rubber) board having a tapered shape. The top surface of the base board 12 may be generally smooth to provide a minimum resistance to the flow of water in the aqueous environment. However, as the smooth surface can be a cause for injury when slick or slippery with water, foot pedal 14 is provided to securely hold a user's foot in place.

The foot pedal 14 is made of a water-proof material and is shaped to partially cover the user's foot while allowing the foot to slip in and pull out without undue effort. The cover portion of the foot pedal 14 helps hold the foot in place, e.g. on the foot pedal 14. The foot pedal 14 has sensors under the bottom surface to detect presence and absence of pressure as well as the degree of pressure and weight distribution between different parts of the foot pedal 14 (e.g., the front and back portions). As will be explained in more detail below, the sensors are electrically coupled to and control the motor 18.

As indicated in FIG. 1, the foot pedal 14 rotates clockwise and counter-clockwise. In some embodiments, the sensors included in the foot pedal 14 detect the rotation and generate electrical signals that are sent to the motor 18. For example, a quick counterclockwise turn with the left foot pedal could turn the motor 18 on in some embodiments. In other embodiments, the rotatable design of the foot pedal is just for ergonomic comfort for the user. In the embodiment shown, there are two foot pedals 14; however, this is not a limitation of the inventive concept.

Figure 2:
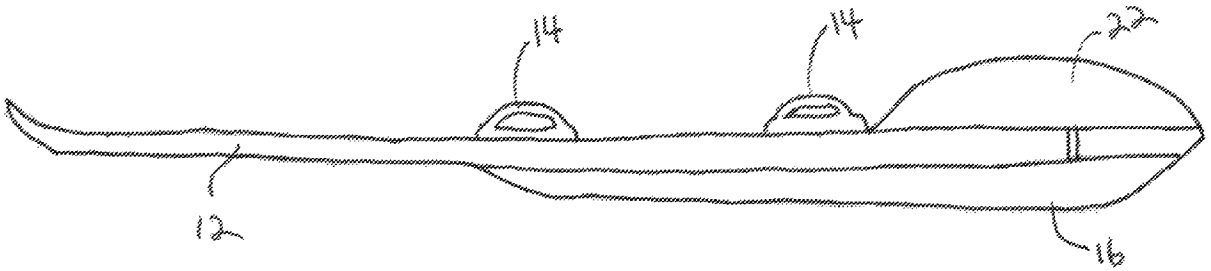
FIG. 2 depicts a side view of the motorized board.
Figure 3:
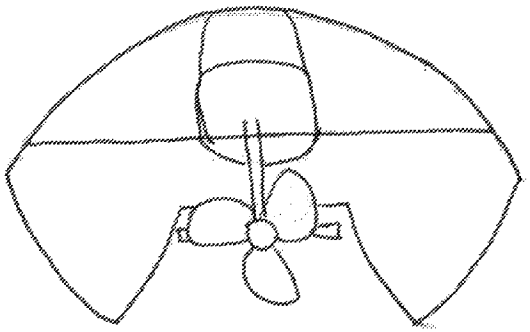
FIG. 3 depicts a rear view (view from the backend) of the motorized board.

FIG. 2 depicts a side view of the motorized board 10, and FIG. 3 depicts a rear view (view from the backend) of the motorized board 10 in accordance with the inventive concept. Although the air bladder 16 is not shown in FIG. 1, FIGS. 2 and 3 depict the air bladder 16. If the base board 12 is an inflatable rubber, the base board 12 and the air bladder 16 may be one integrated piece. If the base board 12 is a plastic board, however, the air bladder 16 may be a separate, inflatable rubber piece that may be attached and detached to the base board 12 as desired. More details about an exemplary coupling mechanism is provided below.

Figure 4:
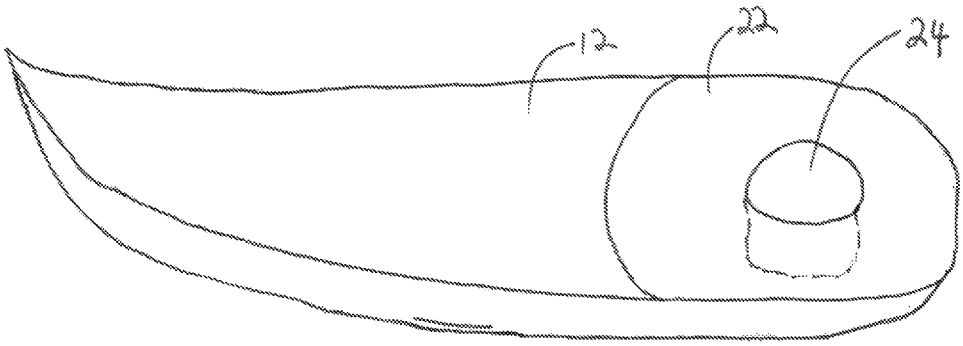
FIG. 4 depicts a base board with a hole for accommodating the motor, in accordance with the inventive concept.
Figure 5:
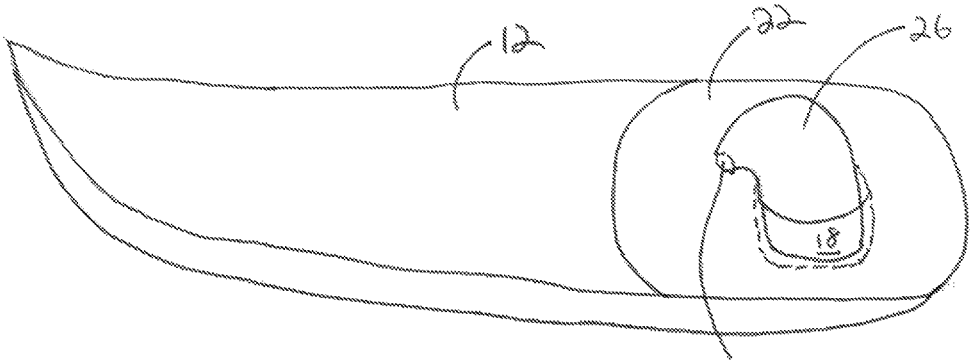
FIG. 5 depicts an example of an inlet cover for the motor.

The motor 18 may be a small outboard motor that is coupled to the base board 12. A hole 24, such as what is shown in FIG. 4, may be formed in the base board 12 to accommodate the motor 18. Any small, conventional outboard motor may be used, along with a gas tank 22 to supply fuel to the internal combustion engine. As the motor 18 is close to the water surface, an inlet cover 26 may be formed to supply air to the internal combustion engine without water getting into the engine. FIG. 5 shows an example of an inlet cover 26, made with a rigid material such as plastic. To minimize the amount of water that goes into the engine, the cover inlet opening 28 preferably faces down, or faces the base board 12.

Figure 6:
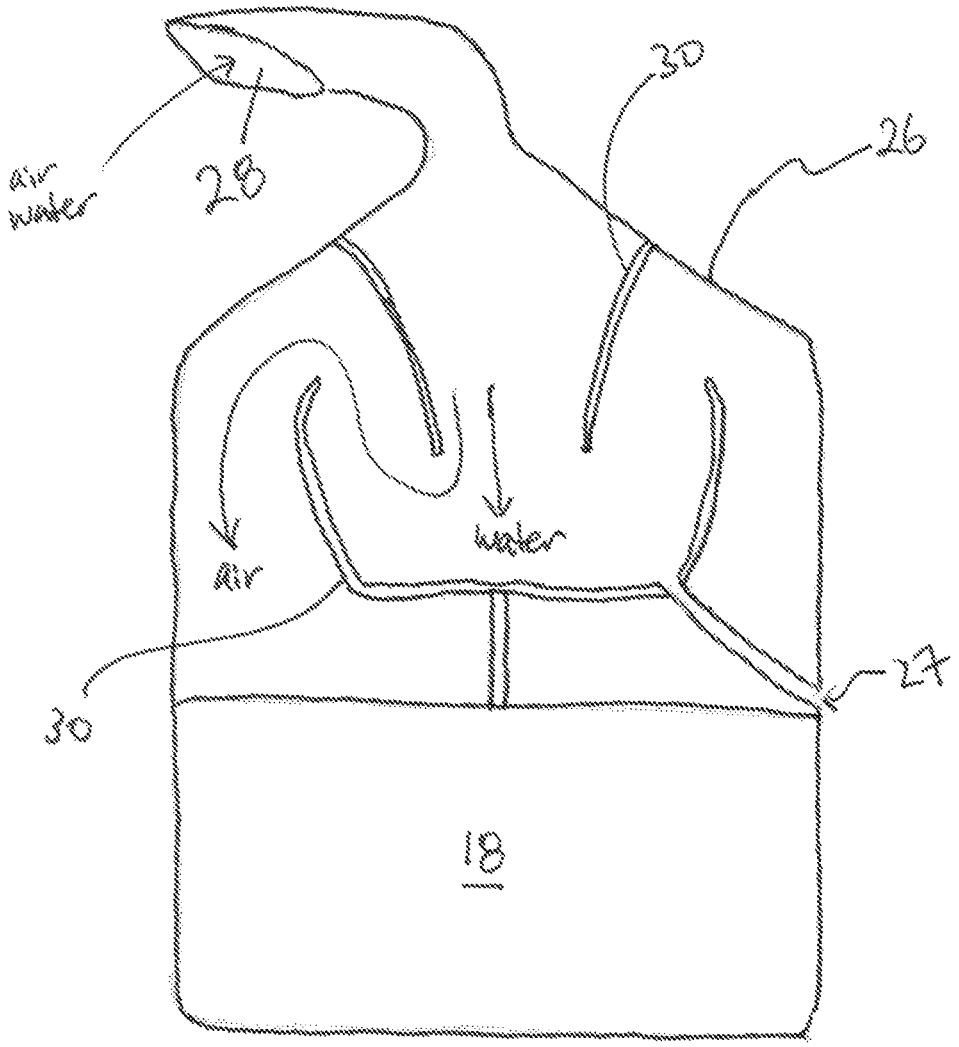
FIG. 6 depicts a cross section of one possible embodiment of the inlet cover.

FIG. 6 depicts a cross section of one possible embodiment of the inlet cover 26. To minimize the amount of water reaching the motor 18, layers of interception plates 30 may be formed inside the inlet cover 26, arranged to allow the air to reach the motor 18 while intercepting any water. Although FIG. 6 depicts a simple configuration of the interception plates 30, many other configurations are possible. Furthermore, the inlet cover 26 may incorporate any mechanism other than the interception plates 30 to prevent water from going into the engine of the motor 18. A water outlet 27 allows any water that collected in the interception plates 30 to flow out of the inlet cover 26. If desired, there may be a small valve placed to close the outlet 27, preventing water from entering via the outlet 27.

In alternative embodiments, the motor 18 may be a battery-operated electric motor instead of an internal combustion engine. In that case, the gas tank 22 would not be present.

Figure 7:
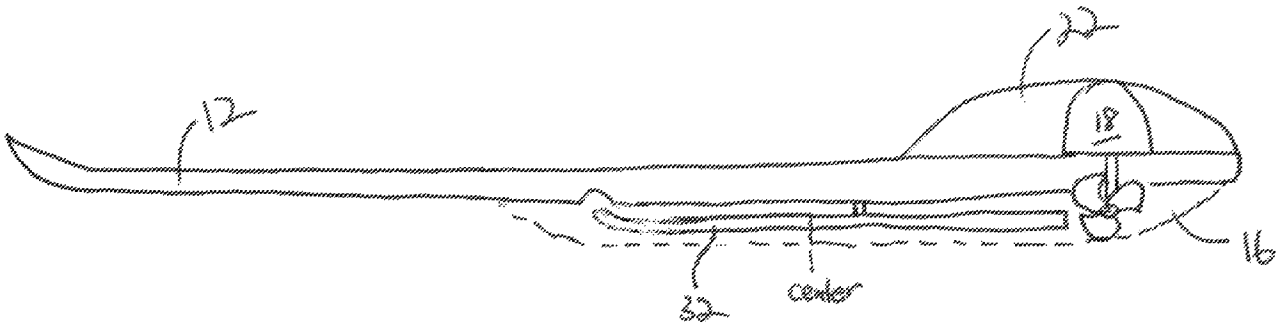
FIG. 7 depicts the lengthwise cross section of the motorized board.
Figure 8:
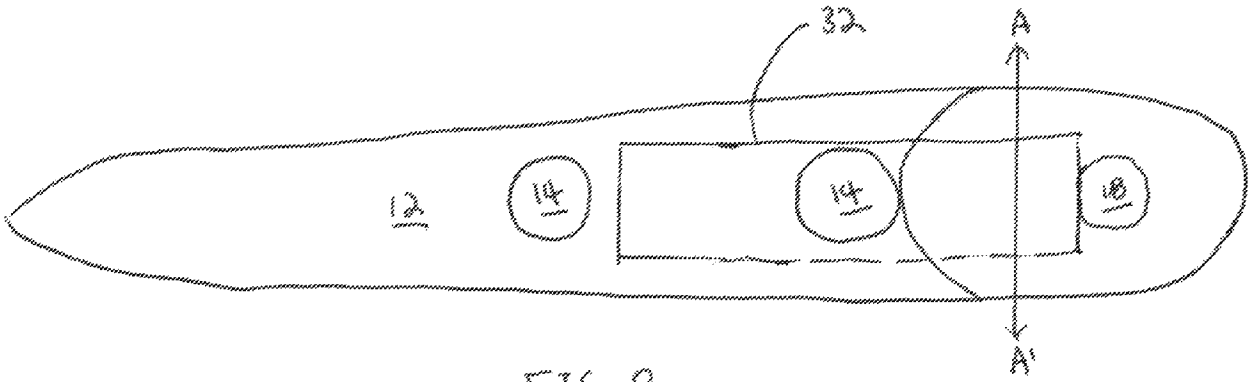
FIG. 8 depicts a top view of the motorized board showing the relative positions of the foot pedal, the wing, and the motor on the base board.
Figure 9A:
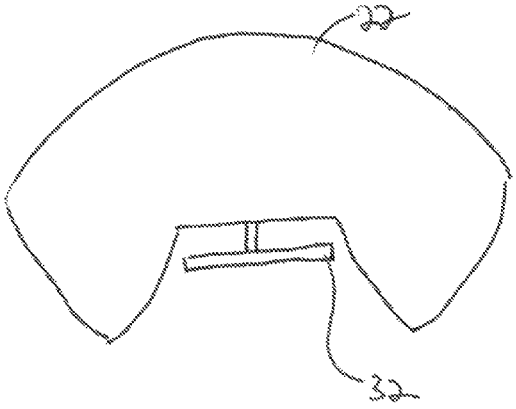
FIG. 9A depicts a cross section along the line A-A' shown in FIG. 8.
Figure 9B:
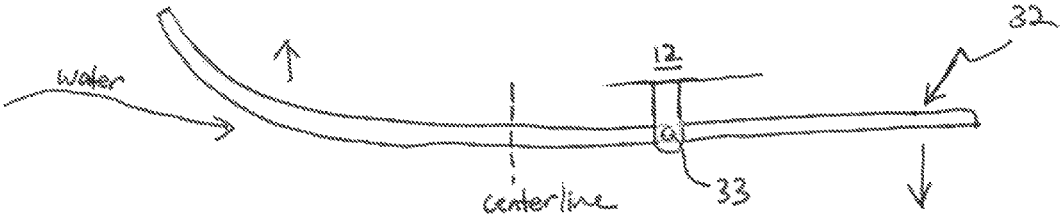
FIG. 9B depicts a side view of the wing coupled to the base board.
Figure 10A:
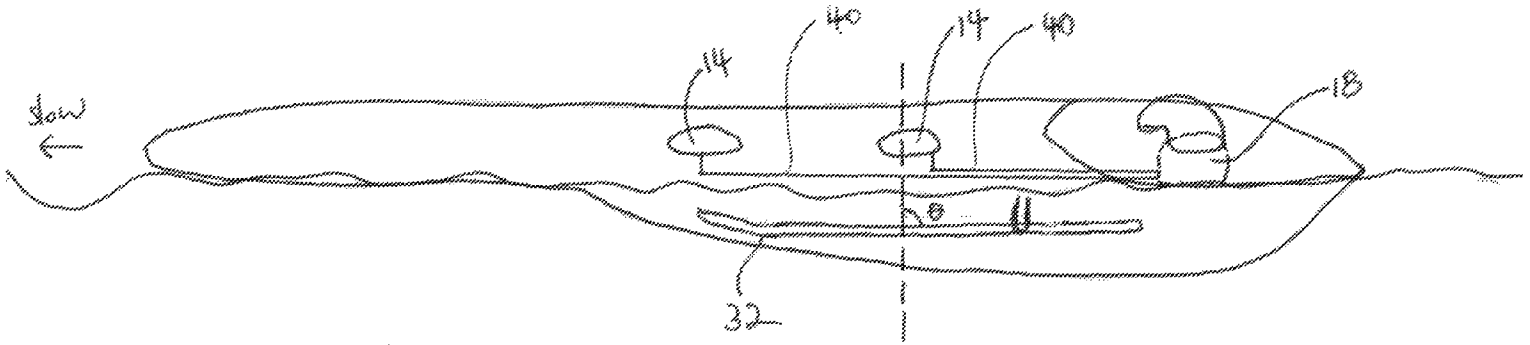
FIG. 10A depicts the motorized board moving at a low speed or not moving on the water surface.
Figure 10B:
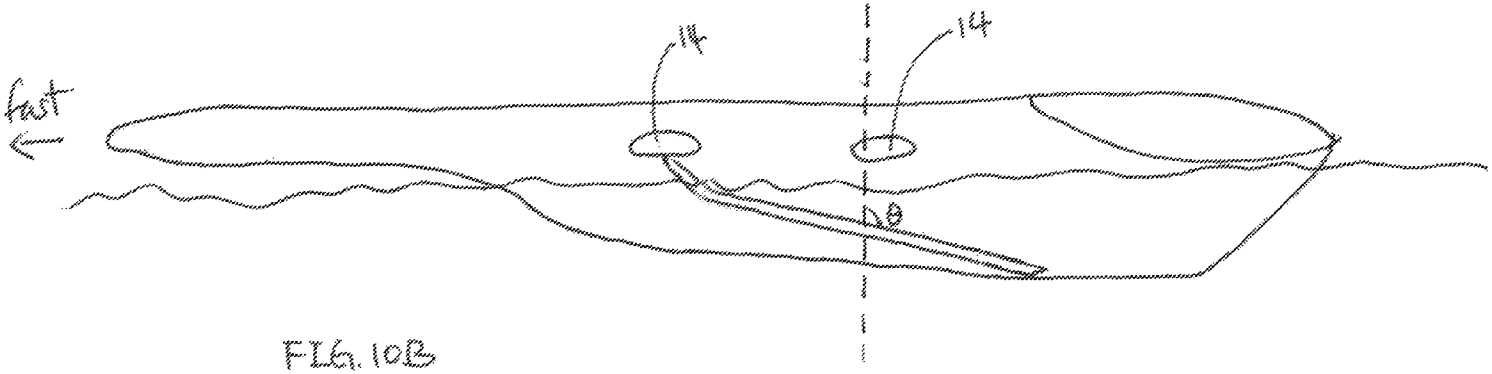
FIG. 10B depicts the motorized board moving at a high speed on the water surface.

The motorized board 10 also includes a wing 32 positioned under the base board 12 and between the air bladders 16. FIG. 7, FIG. 8, FIG. 9A, and FIG. 9B depict the position of the wing 32 under the base board 12. FIG. 7 depicts the lengthwise cross section of the motorized board 10, FIG. 8 depicts a top view of the motorized board 10 showing the relative positions of the foot pedal 14, the wing 32, and the motor 18 on the base board 12, and FIG. 9A depicts a cross section along the line A-A' shown in FIG. 8. As shown, the wing 32 is coupled to the base board 12 in such a way that its distance from the bottom surface of the base board 32 is adjustable. FIG. 9B shows more details about how the wing 32 may be attached to the base board 12 with a bearing 33 that allows the wing 32 to adjust its position in response to the force of the fluid pushing on the front section of the wing 32. As shown, the front part of the wing 32 curves up toward the base board 12 such that when the force of the water pushing the front part of the wing 32 becomes stronger, the front part of the wing 32 move closer to the base board 12. The wing 32 is attached to the base board 12 at a point that is behind the centerline that passes through its center of gravity. When the front part of the wing 32 moves up (closer to the base board 12), the back section automatically moves down (further away from the base board 12), creating an angle θ at the centerline. Although the wing 32 is shown in a position such that it is substantially parallel to the base board 12, an angle θ with respect to the base board 12 may be adjusted, as shown in FIG. 10A and FIG. 10B. The wing 32 may be made of a rigid material that can withstand the force of the fluid, such as plastic.

FIG. 10A depicts the motorized board 10 moving at a low speed in the direction of the arrow, or stopped on the water. As shown, the wing 32 is substantially horizontal to the surface of the water and to the base board 12 in this situation. The angle θ, measured at the centerline, is at substantially 90 degrees. As the motorized board 10 picks up speed and goes faster, however, the wing 32 tilts to lift up the front section of the base board 12 up above the surface of the water, making it easier to move forward. The angle θ becomes greater than 90 degrees at high speeds.

As mentioned above, the foot pedal 14 has sensors that communicate with the motor 18. The communication may happen through hard wires 40 built into the base board 12. Alternatively, the sensors incorporated into the foot pedal 14 may communicate wireless with the motor 18. In one embodiment, absence of pressure on the foot pedal 14 automatically turns off the motor 18. To start the motor 18, the user would push down the front part of his/her foot in the foot pedal 14. By pushing down the front part of the foot again will make the motor 18 turn faster, making the board 10 move at a higher speed. Pushing down the heel may put the motor 18 in a neutral setting while being turned on.

In some embodiments, a remote control, such as one that is attached to a wrist band, may be used instead of or in addition to the foot pedal sensor to control the motor 18 and the wing 32.

Figure 11A:
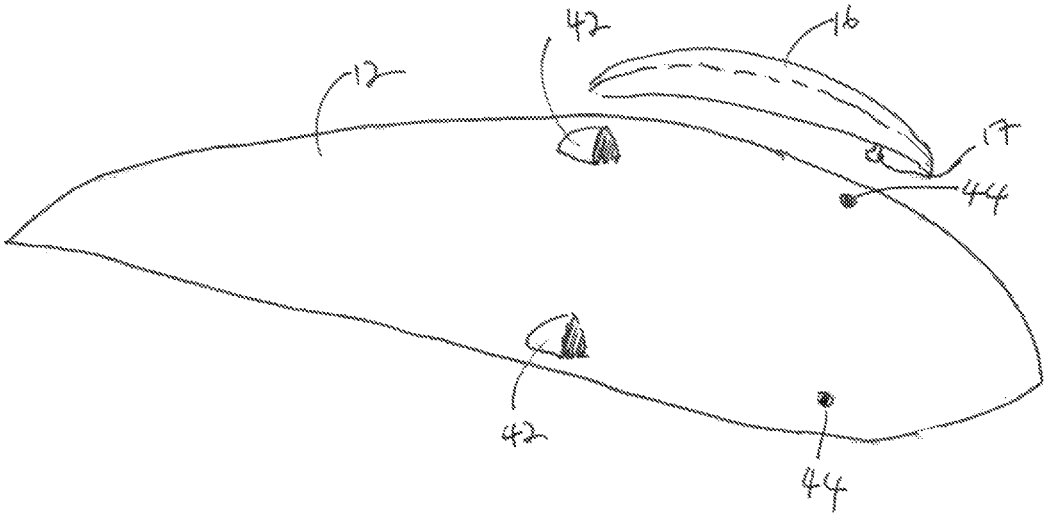
FIG. 11A and FIG. 11B depict an exemplary mechanism by which the air bladder 16 may be attached to the bottom surface of the base board.
Figure 11B:
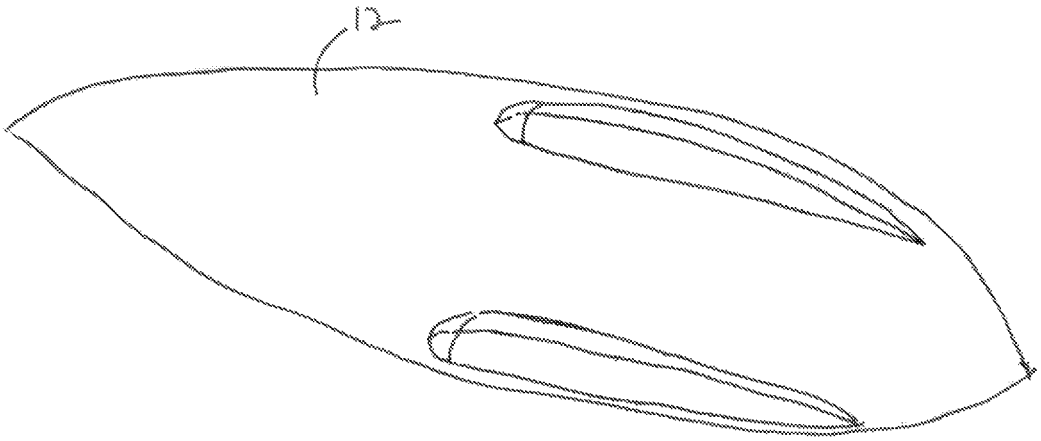

FIG. 11A and FIG. 11B depict an exemplary mechanism by which the air bladder 16 may be attached to the bottom surface of the base board 12. In some cases, for example when the user is very light, it may be desirable to detach the air bladder 16 and use just the base board 12. There are many different mechanisms by which the air bladder 16 may be securely coupled to the base board 12. The mechanism depicted in FIG. 11A and FIG. 11B show a pocket 42 into which one end of the inflated air bladder 16 may be inserted, and a hole 44 into which a pin 17 near the other end of the air bladder 16 may be inserted. The pocket 42 is configured such that the protruding portion of the pocket 42 is closest to the front end. This way, when the board 10 moves forward at a high speed, minimum amount of water will go between the air bladder 16 and the base board 12. While the inventive concept is not limited to any particular mechanism by which the air bladder 16 attaches to the base board 12, whatever mechanism that is used should couple the air bladder 16 to the base board 12 securely enough that no de-coupling happens due to the force of the water even at high speeds.

In the preceding specification, the inventive concept has been described with reference to specific exemplary embodiments. It will, however, be evident that various modifications and changes may be made without departing from the broader spirit and scope of the inventive concept as set forth in the claims that follow. The specification and drawings are accordingly to be regarded as illustrative rather than restrictive. Other embodiments of the inventive concept may be apparent to those skilled in the art from consideration of the specification and practice of the concept disclosed herein.

What is claimed is:

1. A motorized board for use on a water surface, comprising:

a base board having a front end and a back end;

a foot pedal on the base board, wherein the foot pedal is rotatable on the base board;

a motor coupled to the base board and connected to a propeller at the back end, the motor being controlled by the foot pedal; and a wing coupled to a bottom surface of the base board and extending between the front end and the back end, wherein the part of the wing that is close to the front end curves toward the base board and causes the base board to change an angle it makes with respect to the base board according to a speed at which the base board moves.

2. The motorized board of claim 1, wherein the foot pedal comprises a sensor that generates signals to the motor.

3. The motorized board of claim 2, wherein the sensor automatically turns off the motor upon detecting an absence of pressure in the foot pedal.

4. The motorized board of claim 1, wherein the motor comprises an internal combustion engine, further comprising a gas tank positioned near the back end and coupled to the motor.

5. The motorized board of claim 1, wherein the motor is placed in a hole in the base board, further comprising an inlet cover placed over the hole to minimize water from going into the motor, the inlet cover having an opening facing the base board.

6. The motorized board of claim 1, wherein the motor is a battery-operated electric motor.

7. The motorized board of claim 1, further comprising an air bladder on a bottom surface of the base board, the air bladder being a flexible inflatable waterproof container.

8. The motorized board of claim 1, wherein the base board comprises an inflatable waterproof material and an air bladder protruding downward from a bottom portion of the base board.

9. The motorized board of claim 1, wherein the wing is a planar object coupled to the base board at an adjustable angle with respect to the base board.

10. The motorized board of claim 1, wherein a distance between the wing and the base board is adjustable.

* * * * *